US006990740B2

(12) United States Patent
Follo et al.

(10) Patent No.: US 6,990,740 B2
(45) Date of Patent: Jan. 31, 2006

(54) RAZOR ASSEMBLY WITH REPLACEABLE CARTRIDGE

(75) Inventors: Thomas A. Follo, North Milford, CT (US); Andrew J. Pennella, Stamford, CT (US)

(73) Assignee: Eveready Battery Company, Inc., St. Louis, MO (US)

( * ) Notice: Subject to any disclaimer, the term of this patent is extended or adjusted under 35 U.S.C. 154(b) by 0 days.

(21) Appl. No.: 10/325,095

(22) Filed: Dec. 19, 2002

(65) Prior Publication Data

US 2003/0115762 A1 Jun. 26, 2003

Related U.S. Application Data

(60) Provisional application No. 60/343,438, filed on Dec. 21, 2001.

(51) Int. Cl.
*B26B 21/52* (2006.01)

(52) U.S. Cl. ..... 30/532; 30/527

(58) Field of Classification Search ..... 30/50, 30/532, 527, 529, 533, 577, 541, 34.2, 47, 30/5, 547

See application file for complete search history.

(56) References Cited

U.S. PATENT DOCUMENTS

| | | | | | |
|---|---|---|---|---|---|
| 3,935,639 | A | | 2/1976 | Terry, et al. | 30/47 |
| 4,083,104 | A | * | 4/1978 | Nissen et al. | 30/47 |
| 4,266,340 | A | * | 5/1981 | Bowman | 30/532 |
| 4,288,920 | A | * | 9/1981 | Douglass et al. | 30/47 |
| 4,403,414 | A | * | 9/1983 | Kiraly et al. | 30/57 |
| 4,428,116 | A | * | 1/1984 | Chen et al. | 30/532 |
| 4,492,025 | A | * | 1/1985 | Jacobson | 30/530 |
| 4,739,553 | A | * | 4/1988 | Lazarchik | 30/47 |
| 4,785,534 | A | * | 11/1988 | Lazarchik | 30/50 |
| 4,797,998 | A | * | 1/1989 | Motta | 30/530 |
| 5,016,352 | A | * | 5/1991 | Metcalf | 30/532 |
| 5,031,316 | A | | 7/1991 | Oldroyd | 30/47 |
| 5,331,740 | A | | 7/1994 | Carson, et al. | 30/50 |
| 5,333,383 | A | * | 8/1994 | Ferraro | 30/527 |
| 5,526,567 | A | | 6/1996 | Carxon, et al. | 30/50 |
| 5,813,119 | A | | 9/1998 | Ferraro, et al. | 30/49 |
| 5,855,071 | A | | 1/1999 | Apprille, et al. | 30/532 |
| 5,890,296 | A | | 4/1999 | Metcalf, et al. | 30/526 |
| 5,966,822 | A | | 10/1999 | Coffin, et al. | 30/541 |
| 6,029,354 | A | * | 2/2000 | Apprille et al. | 30/47 |
| 6,112,412 | A | | 9/2000 | Richard | 30/41 |
| 6,122,826 | A | | 9/2000 | Coffin, et al. | 30/57 |
| 6,138,361 | A | * | 10/2000 | Richard et al. | 30/50 |
| 6,161,287 | A | | 12/2000 | Swanson, et al. | 30/50 |
| 6,192,586 | B1 | | 2/2001 | Metcalf, et al. | 30/47 |
| 6,434,839 | B1 | * | 8/2002 | Lee et al. | 30/532 |
| 6,526,660 | B1 | * | 3/2003 | MacNeil | 30/61 |
| 2001/0029669 | A1 | * | 10/2001 | Ferraro et al. | 30/49 |
| 2002/0116832 | A1 | * | 8/2002 | Coffin | 30/527 |
| 2002/0138992 | A1 | * | 10/2002 | Richard | 30/527 |

* cited by examiner

*Primary Examiner*—Douglas D. Watts
*Assistant Examiner*—Ghassem Alie
(74) *Attorney, Agent, or Firm*—Michaud-Duffy Group LLP

(57) ABSTRACT

A razor assembly is provided that includes a reusable handle and a replaceable cartridge. The reusable handle includes a grip portion pivotally attached to a cartridge seat. The replaceable cartridge includes a frame and one or more razor blades. The replaceable cartridge is fixedly attached to the cartridge seat of the reusable handle. The replaceable cartridge is selectively separable from the cartridge seat to permit removal of the replaceable cartridge from the reusable handle.

4 Claims, 4 Drawing Sheets

RAZOR ASSEMBLY WITH REPLACEABLE CARTRIDGE

CROSS-REFERENCE TO RELATED APPLICATION

This application claims priority from U.S. provisional patent application No. 60/343,438 filed on Dec. 21, 2001.

BACKGROUND OF THE INVENTION

1. Technical Field

This invention relates to shaving devices in general, and to shaving devices that utilize a replaceable cartridge in particular.

2. Background Information

Modern safety razors include a plurality of blades disposed within a cartridge that is pivotally or rigidly mounted on a handle. Some safety razors have a disposable cartridge for use with a reusable handle, while others have a handle and cartridge that are combined into a unitary disposable. Although a variety of razor cartridge configurations exist, most include a frame made of a rigid plastic that includes a seat and a cap, and the blades are disposed between the cap and the seat. The cartridge further includes a guard disposed forward of the blades. The guard and the cap orient the position of the person's skin relative to the blades to optimize the shaving action of the blade. The terms "forward" and "aft", as used herein, define relative position between two or more things. A feature "forward" of the razor blades, for example, is positioned so that the surface to be shaved encounters the feature before it encounters the razor blades, if the razor assembly is being stroked in its intended cutting direction (e.g., the guard is forward of the razor blades). A feature "aft" of the razor blades is positioned so that the surface to be shaved encounters the feature after it encounters the razor blades, if the razor assembly is being stroked in its intended cutting direction (e.g., the cap is disposed aft of the razor blades).

The comfort and performance provided by a particular razor are critical to the commercial success of the razor. Improvements that benefit razor comfort, performance, and ease of use, however significant or subtle, can have a decided impact on the commercial success of a razor. All attachment mechanisms that pivotally mount a replaceable cartridge on the handle of a razor, of which we are aware, utilize a pivotal connection between the replaceable cartridge and the handle. There are several disadvantages to a pivotal connection between the replaceable cartridge and the handle. For example, an attachment mechanism that must mount and pivotally attach the cartridge will likely be more complex that an attachment mechanism that only mounts. A person of skill in the art will recognize that complexity generally adds cost, increases quality and manufacturing issues, and decreases durability. Another disadvantage of a pivotal connection between the replaceable cartridge and the handle is that very often the replaceable cartridge must include features that enable the pivotal connection, and those features increase the cost of the disposable, replaceable cartridge.

What is needed, therefore, is a durable razor assembly having a replaceable cartridge of minimal complexity, one that facilitates loading and unloading of the replaceable cartridge, and one that is readily manufacturable.

DISCLOSURE OF THE INVENTION

It is, therefore, an object of the present invention to provide a durable razor assembly having a replaceable cartridge of minimal complexity, one that facilitates loading and unloading of the replaceable cartridge, and one that is readily manufacturable.

According to the present invention, a razor assembly is provided that includes a reusable handle and a replaceable cartridge. The reusable handle includes a grip portion that is pivotally attached to a cartridge seat. The cartridge seat includes a first attachment feature. The replaceable cartridge includes a frame, one or more razor blades, and a second attachment feature. The first attachment feature and the second attachment feature combine with each other to fixedly attach the replaceable cartridge to the cartridge seat. The first attachment feature and the second attachment feature are selectively separable to permit removal of the replaceable cartridge from the cartridge seat of the reusable handle.

The present invention razor assembly provides several advantages. For example, the simplicity of the first and second attachment features enables a high quality replaceable cartridge to be manufactured economically. The first and second attachment features fixedly attach the replaceable cartridge to the cartridge seat of the reusable handle and thereby avoid complexities associated with prior art pivotal mounting schemes. Pivotal motion of the replaceable cartridge is accomplished by the pivotal connection between the cartridge seat and grip portion of the reusable handle. The simplicity of the first and second attachment features also increase the ease-of-use of the razor assembly by making the loading and unloading of the replaceable cartridge quite apparent to the user.

Another advantage of the present invention is its durability. Presently available razor assemblies that pivotally mount a replaceable cartridge on a handle utilize a pivotal connection between the replaceable cartridge and the handle. The pivotal nature of the connection increases the complexity of the connection and decreases the durability of the connection. The present invention, in contrast, fixedly attaches the replaceable cartridge to the handle. Pivoting of the cartridge is accomplished via the pivotal connection between the grip portion and the cartridge seat of the reusable handle. Because the pivotal connection of the present invention is provided within the reusable handle, the connection can be made more robust and therefore more durable. The first and second attachment features that fixedly attach the replaceable cartridge to the cartridge seat are simplified to increase their durability and decrease their cost.

These and other objects, features, and advantages of the present invention will become apparent in light of the detailed description of the present invention.

DETAILED DESCRIPTION OF THE INVENTION

Figure 1:
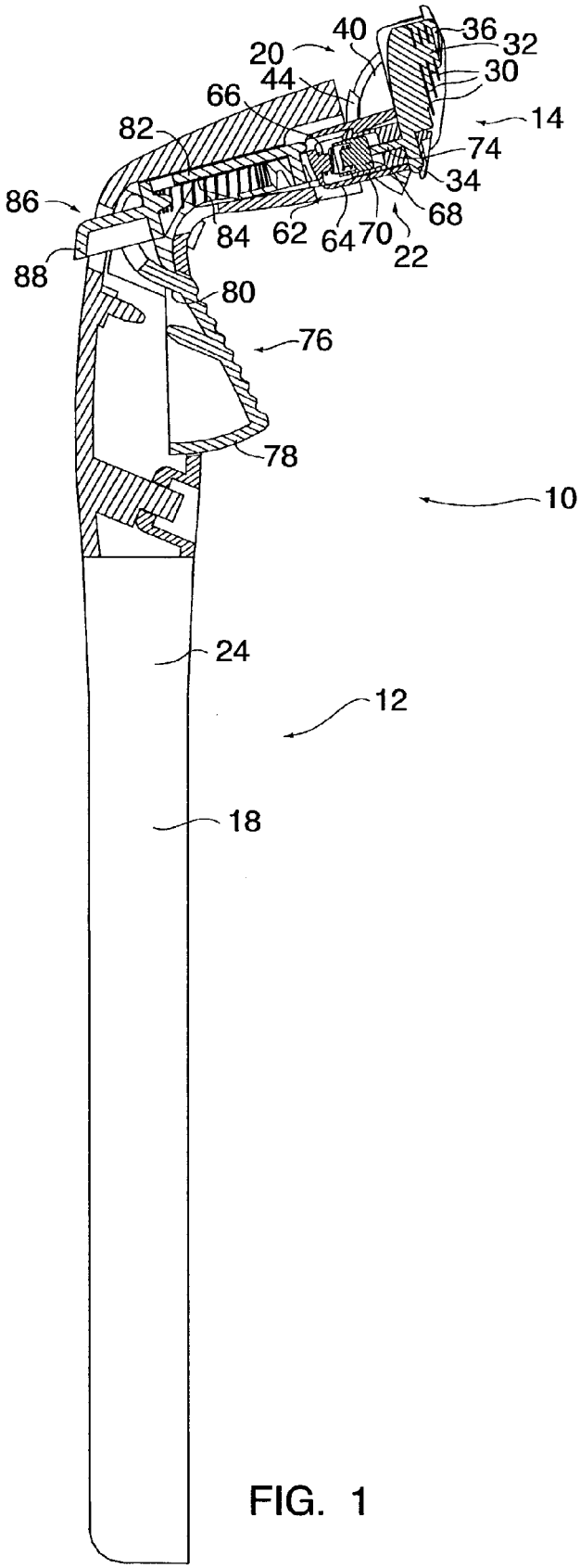
FIG. 1 is a diagrammatic view of a present invention razor assembly, partially sectioned.

Referring to FIGS. 1–6, a razor assembly 10 includes a reusable handle 12 and a replaceable cartridge 14. The reusable handle 12 includes a grip portion 18 and a cartridge seat 20. The grip portion 18 includes a seat mount 22 attached to one end of an elongated member 24. The cartridge seat 20 is pivotally attached to the seat mount 22. The cartridge seat 20 includes a first attachment feature 26 (see FIG. 2). The replaceable cartridge 14 includes a second attachment feature 28. The first attachment feature 26 and the second attachment feature 28 combine to fixedly attach the replaceable cartridge 14 to the cartridge seat 20. The first attachment feature 26 and the second attachment feature 28 are selectively separable to permit removal of the replaceable cartridge 14 from the reusable handle 12.

The replaceable cartridge 14 includes one or more razor blades 30 attached to a frame 32. Depending upon the application, the replaceable cartridge 14 may also include a guard 34 and a shaving aid strip 36 attached to the frame 32. Guards 34 and shaving aid strips 36 are well known in the art and will therefore not be discussed further here other than to say the present invention is not limited to being used with any particular type of guard 34 or shaving aid strip 36.

In the exemplary embodiment shown in FIGS. 1–6, the cartridge seat 20 includes a first arcuately shaped rail 38 and a second arcuately shaped rail 40 in addition to the above-referenced first attachment feature 26. The seat mount 22 includes a first bracket 42 and a second bracket 44, each of which includes a channel 46 shaped to receive the rails 38, 40. Alternatively, the brackets 42, 44 containing the channels 46 can be attached to the cartridge seat 20 and the rails 38, 40 attached to the seat mount 22. A portion or all of each rail 38,40 is received within a channel 46 and can be slidably moved relative to the channel 46 to enable pivotal motion of the cartridge seat 20. The first attachment feature 26 of the cartridge seat 20 includes a pair of tab pockets 48,50. The second attachment feature 28 of the replaceable cartridge 14 consists of a pair of tabs 52,54 shaped so as to be receivable within the tab pockets 48,50. A raised lip 56 (see FIG. 6) or other detent mechanism (e.g. a ball and dimple, etc.) is provided to maintain the tabs 52, 4 within the tab pockets 48,50. Other mechanisms for maintaining the tabs 52,54 within the tab pockets 48,50 may be used alternatively. The tabs 52,54 and tab pockets 48,50 enable the replaceable cartridge 14 to be selectively separable from the reusable handle 12.

Figure 2:
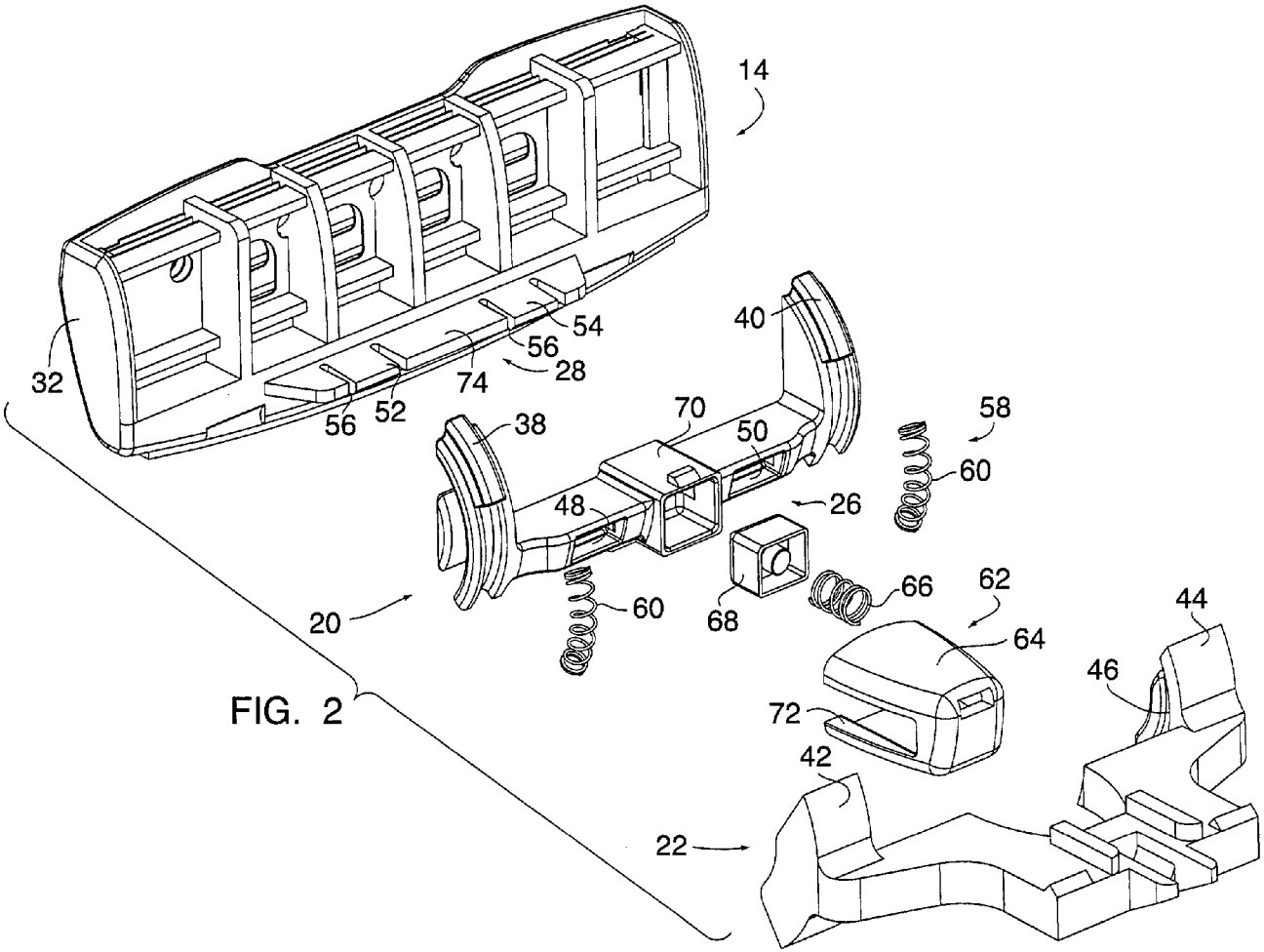
FIG. 2 is a diagrammatic exploded partial view of the present invention razor assembly.
Figure 3:
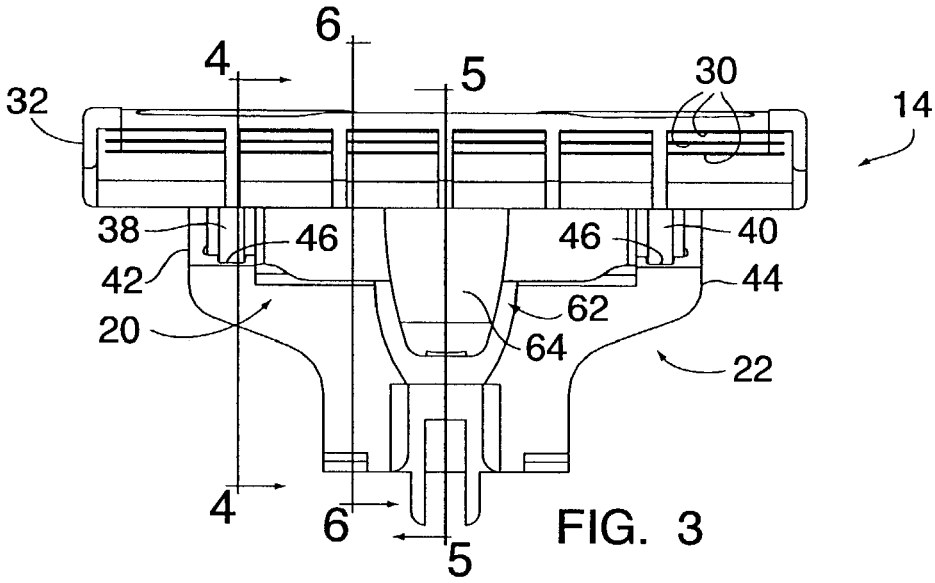
FIG. 3 is a diagrammatic planar partial view of the present invention razor assembly.
Figure 4:
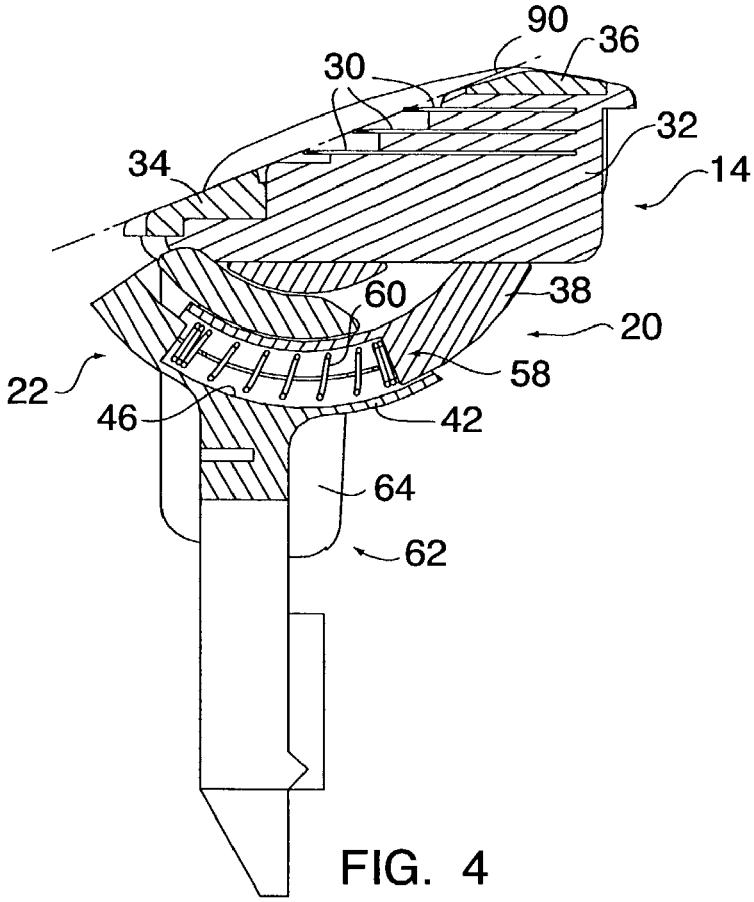
FIG. 4 is a sectional view of the razor assembly shown in FIG. 3, sectioned along line 4—4.

Referring to FIGS. 2 and 4, in a preferred embodiment the razor assembly 10 further includes a cartridge biasing mechanism 58 that biases the replaceable cartridge 14 into a predetermined position. The cartridge biasing mechanism 58 includes a pair of springs 60; each disposed within one of the channels 46 in the seat mount 22. The springs 60 act between the seat mount 22 and the cartridge seat 20, thereby biasing the cartridge seat 20 and attached replaceable cartridge 14 into a predetermined position at one end of the pivotal travel between the cartridge seat 20 and the seat mount 22.

Figure 5:
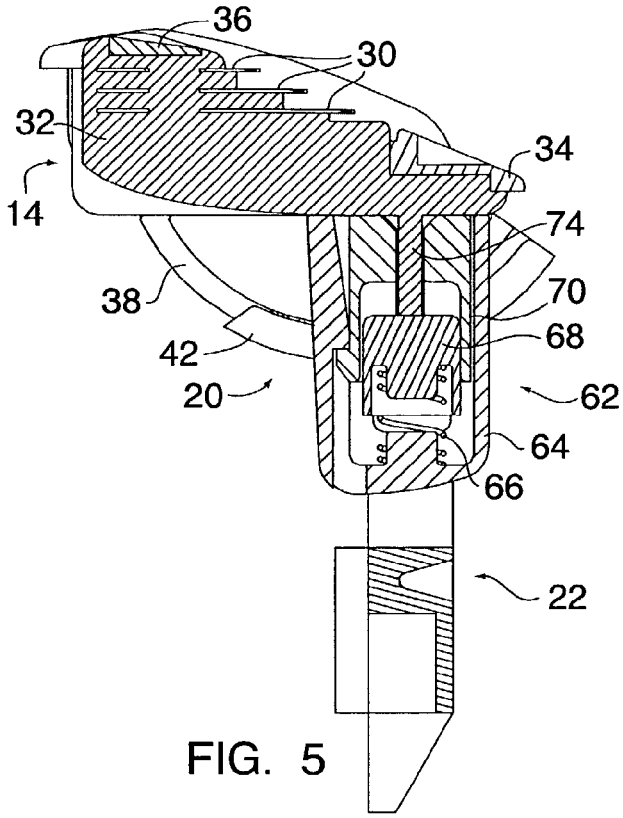
FIG. 5 is a sectional view of the razor assembly shown in FIG. 3, sectioned along line 5—5.
Figure 6:
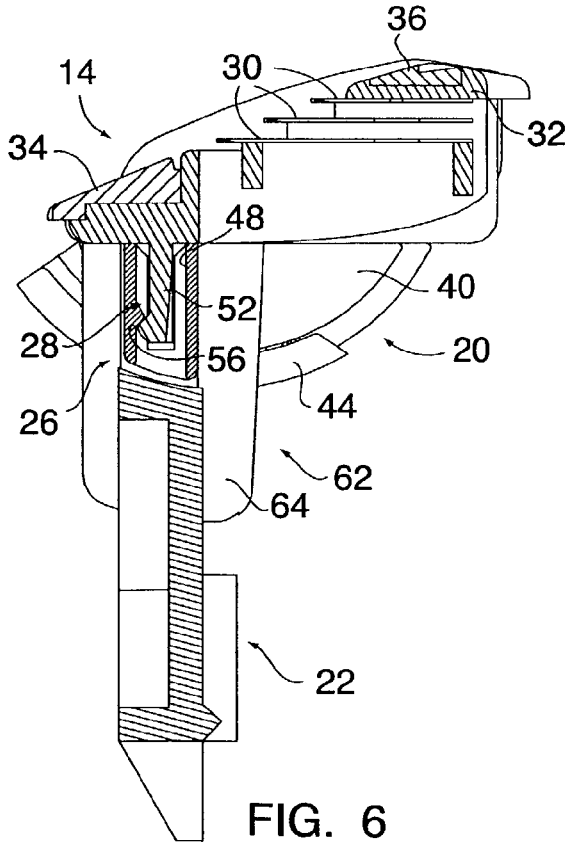
FIG. 6 is a sectional view of the razor assembly shown in FIG. 3, sectioned along line 6—6.

Referring to FIGS. 1, 2, and 5, in a preferred embodiment the razor assembly 10 further includes an ejector 62 for selectively separating the replaceable cartridge 14 from the reusable handle 12. In the exemplary embodiment shown in FIGS. 1, 2, and 5, the ejector 62 includes an ejector housing 64, a spring 66, and a spring block 68. The spring block 68 is received within a pocket 70 disposed within the cartridge seat 20. The ejector housing 64 includes a slot 72 for receiving a portion of the cartridge seat 20. The spring 66 acts between the ejector housing 64 and the spring block 68. The spring block 68 is in contact with a center tab 74 of the replaceable cartridge 14, thereby biasing the replaceable cartridge 14 and assisting in maintaining the engagement of the detent features (e.g., the raised lip 56). In alternative embodiments, the spring block 68 can be fixedly attached to cartridge seat 20. The present razor assembly 10 embodiment shown in FIG. 1 further includes a first actuator 76 for actuating the above-described ejector 62. The first actuator 76 includes a pivotally mounted trigger 78 and spur 80, a slide 82, and a slide spring 84. The first end of the slide 82 is disposed adjacent the pivotally mounted spur 80 and a second end of the slide 82 is disposed adjacent the ejector housing 64. The slide spring 84 biases the slide 82 into contact with the spur 80 and thereby biases the trigger 78 outwardly. The embodiment of the present razor assembly 10 shown in FIG. 1 further includes a second actuator 86 for actuating the above-described ejector 62 that can be provided with, or in place of, the above-described first actuator 76. The second actuator 86 includes a button 88 that is attached to the slide 82.

In the operation of the razor assembly 10, the user selectively attaches a replaceable cartridge 14 to the reusable handle 12. Specifically, the replaceable cartridge 14 is fixedly attached to the cartridge seat 20 by inserting the tabs 52,54 of the replaceable cartridge 14 into the tab pockets 48,50 of the cartridge seat 20. The detent mechanism on each tab 52,54 (e.g., raised lip 56) maintains the tab 52,54 within the tab pocket 48, 50. The cartridge seat 20 is pivotally attached to the seat mount 22, and the seat mount 22 is fixedly attached to the elongated member 24 of the handle grip portion 18. The pivotal attachment between the cartridge seat 20 and the seat mount 22 enables the replaceable cartridge 14 to rotate relative to the handle 12 to accommodate surface contour changes as the razor assembly 10 is stroked across the surface to be shaved.

In the exemplary embodiment shown in FIGS. 1–6, the replaceable cartridge 14 is biased in a predetermined position by the springs 60 of the cartridge biasing mechanism 58 (see FIGS. 2 and 4). Force applied normal to the shave plane 90 of the replaceable cartridge 14 will oppose the force of the cartridge biasing mechanism 58. When the normal force is greater than the biasing force, the springs 60 compress and allow the replaceable cartridge 14 to rotate relative to the handle 12. The biasing force maintains the razor blades 30 of the replaceable cartridge 14 in contact with the surface to be shaved. The magnitude of the biasing force can be altered (e.g., stronger/weaker springs 60) to create desirable shaving characteristics for a particular razor assembly 10 and/or application. When the normal force is removed, the springs 60 of cartridge biasing mechanism 58 will bias the replaceable cartridge 14 back into the predetermined position.

When the user elects to replace the replaceable cartridge 14 with a new cartridge 14, the user actuates one of the trigger 78 or the button 88. Actuation of either the trigger 78 or the button 88 causes the slide 82 to move the ejector housing 64. Movement of the ejector housing 64, in turn, dislodges the detent mechanism (e.g., raised lip 56) on each table 52,54 and causes the replaceable cartridge 14 to be ejected from the tab pockets 48,50. The spring 66 acting between the spring block 68 and the ejector housing 64 assists the ejection of the replaceable cartridge 14. Once the used replaceable cartridge 14 is ejected, a new replaceable cartridge 14 can be fixedly attached to the cartridge seat 20 in the manner described above; i.e., by inserting the tabs

52,54 attached to the replaceable cartridge 14 into the tab pockets 48,50 disposed within the cartridge seat 20.

Although this invention has been shown and described with respect to the detailed embodiments thereof, it will be understood by those skilled in the art that various changes in form and detail thereof may be made without departing from the spirit and scope of the invention. For example, in the Detailed Description above, the pivotal connection between the cartridge seat and the seat mount is described in terms of a preferred arcuate rail and channel arrangement. Alternative pivot mechanisms within the reusable handle may be used alternatively.

What is claimed is:

1. A razor cartridge assembly, comprising:

a reusable handle including a grip portion and a seat mount;

the seat mount including a first bracket having a channel, and a second bracket having a channel;

a cartridge seat including a first arcuately shaped rail, a second arcuately shaped rail, and a first attachment feature comprising one or more tab pockets, the channels of the seat mount being shaped to slidably receive the rails of the cartridge seat, thereby enabling the cartridge seat to pivot relative to the reusable handle;

a replaceable cartridge including a frame, one or more razor blades coupled to the frame and a second attachment feature comprising one or more tabs shaped so as to be receivable within the one or more tab pockets of the cartridge seat, the first attachment feature of the cartridge seat and the second attachment feature of the replaceable cartridge being a mating male and female pair, and the first attachment feature combines with the the second attachment feature to fixedly attached the cartridge seat to the replaceable cartridge;

the replaceable cartridge being selectively separable from the cartridge seat to permit removal of the replaceable cartridge from the reusable handle;

a detent mechanism to assist in maintaining the tabs within the tab pockets;

a cartridge biasing mechanism including one or more springs, wherein the mechanism biases the replaceable cartridge toward a predetermined position, and wherein the one or more springs are disposed within one or more of the channels in the seat mount; and an ejector to selectively separate the replaceable cartridge from the cartridge seat of the reusable handle.

2. The razor assembly of claim 1, wherein the ejector includes a spring and an ejector housing that includes a slot for receiving a portion of the cartridge seat, wherein the spring acts between the ejector housing and the cartridge seat; and wherein actuation of the ejector housing in a direction toward the replaceable cartridge a sufficient amount will cause the replaceable cartridge and cartridge seat to separate from one another.

3. The razor assembly of claim 2, further including an actuator for actuating the ejector, wherein the actuator comprises a pivotally mounted trigger and spur, a slide, and a slide spring;

wherein the slide is disposed between the pivotally mounted spur and the ejector housing and the slide spring biases the slide toward the spur;

wherein actuation of the trigger causes the spur to contact and move the slide into contact with the ejector housing.

4. The razor assembly of claim 2, further including an actuator for actuating the ejector, wherein the actuator comprises a button, a slide, and a slide spring;

wherein the actuator comprises a button, a slide, and a slide spring;

wherein the slide is disposed between the button and the ejector housing and the slide spring biases the slide toward the button;

wherein actuation of the button causes the button to contact and move the slide into contact with the ejector housing.

* * * * *

UNITED STATES PATENT AND TRADEMARK OFFICE

CERTIFICATE OF CORRECTION

PATENT NO. : 6,990,740 B2 
DATED : January 31, 2006
INVENTOR(S) : Thomas A. Follo and Andrew J. Pennella It is certified that error appears in the above-identified patent and that said Letters Patent is hereby corrected as shown below:

Column 5,
Line 34, delete the second occurrence of "the".
Line 35, delete "attached" and substitute -- attach --.

Column 6,
Line 29, after "actuating the ejector" delete ", wherein the actuator comprises a button, a slide, and a slide spring".

Signed and Sealed this

Twenty-eighth Day of March, 2006

JON W. DUDAS
*Director of the United States Patent and Trademark Office*